US005419560A

United States Patent [19]

Bamber

[11] Patent Number: 5,419,560

[45] Date of Patent: May 30, 1995

[54] PERIMETER WEIGHTED GOLF CLUBS

[76] Inventor: Jeffrey V. Bamber, 5023 Village Dr., Cincinnati, Ohio 45244

[21] Appl. No.: 213,622

[22] Filed: Mar. 15, 1994

[51] Int. Cl.[6] ..... A63B 53/04

[52] U.S. Cl. ..... 273/169; 273/167 F

[58] Field of Search ..... 273/169, 167 F, 170, 273/171, 172

[56] References Cited

U.S. PATENT DOCUMENTS

| | | | |
|---|---|---|---|
| 3,655,188 | 4/1972 | Solheim | 273/77 A |
| 3,888,492 | 6/1975 | Cabot | 273/171 X |
| 3,897,065 | 7/1975 | Solheim | 273/167 A |
| 4,521,022 | 6/1985 | Schmidt | 273/175 |
| 4,534,558 | 8/1985 | Yoneyama | 273/78 |
| 4,621,813 | 11/1986 | Solheim | 273/77 A |
| 4,630,825 | 12/1986 | Schmidt et al. | 273/167 H |
| 4,754,969 | 7/1988 | Kobayashi | 273/77 A |
| 4,802,672 | 2/1989 | Long | 273/77 A |
| 4,854,581 | 8/1989 | Long | 273/77 A |
| 4,858,929 | 8/1989 | Long | 273/77 A |
| 4,884,812 | 12/1989 | Nagasaki et al. | 273/167 H |
| 4,964,640 | 10/1990 | Nakanishi et al. | 273/167 H |
| 5,046,733 | 9/1991 | Antonious | 273/77 A |
| 5,110,131 | 5/1992 | Long | 273/167 H |
| 5,193,805 | 3/1993 | Solheim | 273/77 A |
| 5,282,625 | 2/1994 | Schmidt et al. | 273/167 H |
| 5,322,285 | 6/1994 | Turner | 273/164.1 |
| 5,332,223 | 7/1994 | Johnson | 273/169 |
| 5,333,860 | 8/1994 | Saito et al. | 273/77 A |
| 5,335,914 | 8/1994 | Long | 273/169 |

OTHER PUBLICATIONS

Golg Digest, Feb., 1995, "Evolution of a Clubhead", pp. 110–114.

Golf Magazine March, 1991, Taylor Made ICW11 iron advertisement pp. 40–41.

Golfsmith, May, 1994 Catalog, O/S Project Oversize Irons advertisement, p. 7.

Peerless PHD advertisement, Golf Digest, Sep. 1993 issue, insert (unnumbered pages).

"Big Irons Big Money", Chris Millard, Golf World, Feb. 18, 1994 issue, pp. 46–69.

"Club Test 94", Rob Saneshaft, Golf Magazine, Mar. 1994, issue, pp. 36∝40, 42–49, 52–54, 59, 62, 63, 66–68, 72–75, 78,80, 82,84, 88–94, 96–102.

Golfsmith, Holiday (Dec. 1992) catalog, Iron/Wood and Gear Effect Driving Iron advertisement, p. 8.

Austads, Christmas (Dec. 1991) catalog, Captain Hook, metal woods, p. 43.

Herrington Catalog, Spring, 1994, Gallaway Big Berlha, irons, pp. 3 and 4.

*Primary Examiner*—William H. Grieb

*Attorney, Agent, or Firm*—Jeffrey V. Bamber

[57] ABSTRACT

Improved perimeter weighted golf clubs are disclosed. The perimeter weighted golf clubs of the present invention are provided with improved structures for distributing the weight at the perimeter of the club head. In one embodiment, the club head has a club face with a hitting surface and a thinned portion outboard of the hitting surface which connects the hitting surface and the weighted perimeter of the club head. In another embodiment, the club head has a tubular frame which surrounds and supports at least a portion of the hitting surface.

33 Claims, 2 Drawing Sheets

PERIMETER WEIGHTED GOLF CLUBS

FIELD OF THE INVENTION

This invention relates to golf clubs, more particularly to golf club heads. More particularly still, this invention relates to perimeter weighted golf clubs that have improved structures for distributing the weight at the perimeter of the club head.

BACKGROUND OF THE INVENTION

In golf club design, iron golf clubs have undergone an evolution. Irons originally had relatively flat "blade" club heads.

The design of iron-type golf clubs then evolved into club heads of the "cavity back" type. Cavity back designs involve taking the weight from the center of the club head and redistributing it to the toe and heel portions of the club head while leaving a cavity behind the hitting area. Irons having a cavity back design which have been marketed on a wide scale by Karsten Mfg. of Phoenix, Ariz. under the trademark "PING" are described in U.S. Pat. Nos. 3,655,188, 3,897,065, the patent issued out of application Ser. No. 07/620,521 on Apr. 23, 1985, and U.S. Pat. No. 4,621,813, all issued to Solhelm. While the irons sold under the trademark "PING" have been highly successful, the search for improved perimeter weighted iron club head designs has continued.

More recently, the design of wood and iron-type golf club heads has been directed to so-called "oversized" club heads. Examples of such clubs are BIG BERTHA metal woods manufactured by Callaway Golf of Carlsbad, Calif., BIG HEAD oversized metal woods and irons manufactured by Head of Fort Worth, Tex., DOCTOR oversized irons manufactured by MacGregor of Albany, Ga., KING COBRA oversized metal woods and irons manufactured by Cobra Golf, Inc. of Carlsbad, Calif., and KILLER WHALE metal woods manufactured by Wilson Sporting Goods of Chicago, Ill.

There is room for improvement in the design of all of the aforementioned clubs. For example, one drawback in these clubs is that the perimeter weighting is not distributed as efficiently as it could potentially be distributed. Another drawback is that the appearance of these clubs is such that the player might tend to believe that using such clubs will result in a sliced shot due to the fact that many of iron club heads fan out from the rear of the toe of the club head.

The design of iron clubheads is governed by Rule 4-1d in Appendix II of the rules of the United States Golf Association (the "USGA"). Rule 4-1d requires that:

- The clubhead shall be generally plain in shape. All parts shall be rigid, structural in nature and functional.
- Features such as holes through the head, windows or transparancies, or appendages to the main body of the head such as plates, rods, or fins for the purpose of meeting dimensional specifications, for aiming or for any other purpose are not permitted.

Golf clubs must meet the requirements of the USGA to be considered "legal" for tournament play.

Thus, a need exists for improved perimeter weighted golf clubs clubs that conform to the requirements of the Rules of Golf of the USGA. In particular, a need exists for perimeter weighted golf clubs that have improved appearance and improved structures for distributing the weight around the perimeter of the club head.

These and other objects of the present invention will be more readily apparent when considered in reference to the following description and when taken in conjunction with the accompanying drawings.

SUMMARY OF THE INVENTION

The present invention relates to improved perimeter weighted golf clubs, particularly those of the iron type. It should be understood, however, that the same principles can also be applied to the design of "metal" wood type clubs. The perimeter weighted golf clubs of the present invention are provided with improved structures for distributing the weight around the perimeter of the club head.

The first basic embodiment of the golf club of the present invention has a club head having a club face with a hitting surface and a thinned portion outboard of the hitting surface which connects the hitting surface and the weighted perimeter portion of the club head. The thinned portion allows the weighted perimeter portion of the club head to be disposed further outward from the hitting surface than in current cavity back clubs to increase the efficiency of the perimeter weighting. The aforementioned embodiment of the present invention can also provide an "oversized" iron club head without substantially increasing the mass of the club head.

In a second basic embodiment, the golf club comprises an iron or a metal type wood club head with a main body (or frame) at least a portion of which is tubular. In a particularly preferred version of this embodiment, the tubular portion of the frame is a flattened tubular structure. The tubular frame provides a strong structure that is much lighter in weight than perimeter weighted golf clubs of the type described in the aforementioned patents. This allows a larger club head to be created without the mass of current perimeter weighted clubs.

A non-limiting number of additional features which can be incorporated into these embodiments and a non-limiting number of additional embodiments are also described herein.

BRIEF DESCRIPTION OF THE DRAWINGS

While the specification concludes with claims particularly pointing out and distinctly claiming the present invention, it is believed the invention will be better understood from the following description taken in conjunction with the accompanying drawings.

DETAILED DESCRIPTION OF THE INVENTION

I. First Basic Embodiment

Figure 1:
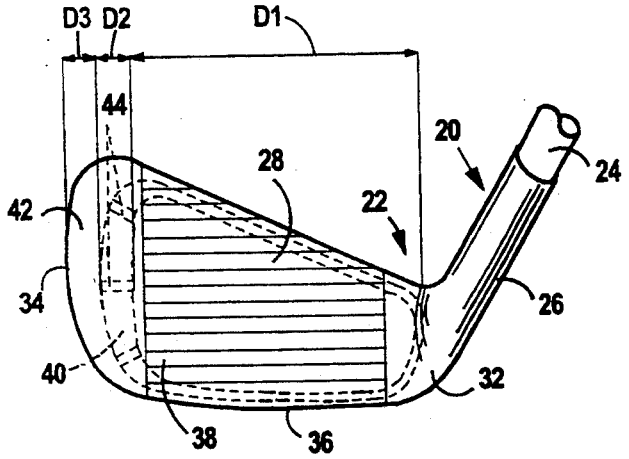
FIG. 1 is a front elevational view of the club head of the present invention which is provided with a spacer between the hitting surface and the weighted perimeter portion.
Figure 2A:
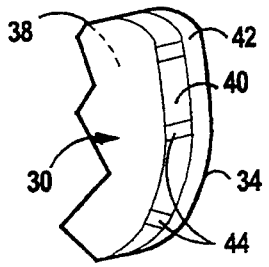
FIG. 2A is a fragmentary rear elevational view of a portion of an alternative version of the club head shown in FIG. 2 in which the weighted perimeter portion is disposed only along the toe of the club head.
Figure 2:
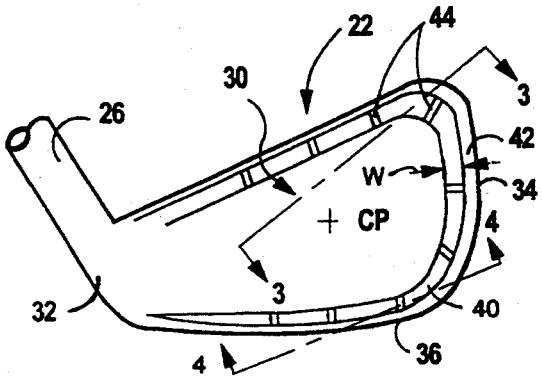
FIG. 2 is a rear elevational view of the club head shown in FIG. 1.
Figure 3:
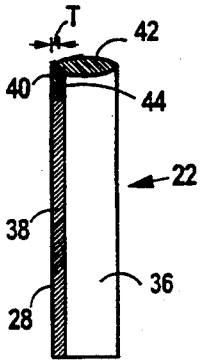
FIG. 3 is a cross sectional view taken along line 3—3 of FIG. 2.

FIGS. 1-3 show a first embodiment of the improved perimeter weighted golf club 20 of the present invention which has an iron-type club head. The golf club comprises a club head 22 and a shaft 24. The club head 22 comprises a hosel 26 connected to the lower end of the shaft 24. The hosel 26 is integrally formed with the club head. In addition to the hosel 26, the club head 22 includes a club face 28, a back surface 30, a heel portion 32, a toe portion 34, and a sole 36.

The club head 22 has a club face 28 with a hitting surface 38, a thinned portion 40 outboard of the hitting surface 38, and a weighted perimeter portion 42. The term "outboard", as used herein, refers to locations that are spaced away from the center of percussion of the club head, CP. The weighted perimeter portion 42 may, but need not surround the entire perimeter of the hitting surface 38. FIG. 2A shows an alternative embodiment of the present invention in which the weighted perimeter portion 42 is disposed only around a portion of the perimeter of the hitting surface 38. Preferably, the weighted perimeter portion 42 is disposed at least along at least a portion of the toe 34 of the club head. Preferably, as shown in FIG. 2A, the weighted perimeter portion 42 is disposed at least along the entire toe 34 of the club head.

The thinned portion 42 connects the hitting surface 38 and the weighted perimeter portion 42 of the club head. The thinned portion 40 spaces the weighted perimeter portion 42 away from the hitting surface. The thinned portion 40 may, therefore, be referred to as a "spacer".

The thinned portion 40 generally has a thickness, T, that is thinner than at least some portions of the hitting surface 38. Often, the hitting surface 38 will have a relatively uniform thickness so the thinned portion 40 will be thinner than the entire hitting surface 38. FIG. 3 shows that in cross-section, the thinned portion 40 may be flush with the hitting surface 38 and the weighted perimeter portion 42 has a thickness greater than both the thinned portion 40 and the hitting surface 38.

FIG. 2 shows that the width of the thinned portion, W, may vary, for example, so that it is greater along the toe 34 of the club head than at the sole or at the top edge of the club head. Alternatively, the width of the thinned portion may be uniform around the perimeter of the hitting surface 38. In alternative embodiments, the width of the thinned portion 40 (and the width of the weighted perimeter portion 42) may vary from club to club to provide a correlated set of clubs within which set each club has an optimal weight distribution.

The thinned portion 40 may, but need not be thick enough to withstand the impact of the club head hitting a golf ball. This is possible because of several factors. First, the thinned portion 40 is preferably disposed far enough outward of the hitting surface 38 so that even the worst mis-struck shots will not contact the thinned portion 40.

For example, the hitting surface 38 may have a maximum width, D1, measured parallel to the sole 36 of the club from the point adjacent the hosel 26 where the curvature of the hosel ends (and the flat hitting surface 38 begins) to the beginning of the thinned portion 40. The club head also has a distance D2 equal to the width of the thinned portion 40, and a distance D3 equal to the width of the weighted perimeter portion 42 which are both measured at the point of maximum width of the club head in a direction parallel to the sole 36 of the club.

Without wishing to be bound to club heads of any particular dimensions, the maximum width, D1, of the hitting surface 38 may, for example, range from a size that is sufficiently small so that the overall maximum width of the club head (D1+D2+D3) is only approximately the same as the width of a conventional blade-type iron (e.g., for a 5 iron, the overall maximum width of the club head may be about 2.75 inches), or less, to a size that is greater than or equal to the total width of any currently used clubs, including oversized clubs (so that the distance D1 itself is the size of such clubs—e.g., D1 itself is greater than or equal to about 2.75 inches, 3 inches, 3.25 inches, 3.5 inches . . . etc.) in which case the inner dotted line in FIG. 1 representing the hitting surface 38 is equal in size to any such currently used clubs. For the purpose of determining the actual size of currently used clubs, the dimensions of the clubs described in the patents incorporated by reference herein and the clubs described in the Feb. 18, 1994 issue of Golf World magazine and the March, 1994 issue of Golf Magazine, as well as their manufacturer's specifications are incorporated by reference herein. The loft of such iron club heads may be greater than or equal to about 17 degrees for a one iron. The width of the thinned portion D2 may, for example, then be about $\frac{1}{8}$ inch, $\frac{1}{4}$ inch, $\frac{1}{2}$ inch; $\frac{3}{4}$ inches, 1 inch, or more. The width of the weighted perimeter portion D3 may, for example be in about the same range as those widths given for the width of the thinned portion D2, but D2 and D3 need not be the same.

Second, if the thinned portion is not disposed far enough away from the hitting surface 38 to avoid mis-struck shots, the thinned portion 40 may be made narrow enough in width that the impact of the ball is absorbed by a portion of the hitting surface 38 and a portion of the weighted perimeter portion 42. In such a case, the thinned portion 40 merely bridges these other portions of the club head that are absorbing the impact.

Third, in the embodiment shown in FIGS. 1-3, the thinned portion 40 may be reinforced against the forces created by the impact with a golf ball by reinforcing members 44 that extend between the hitting surface 38 and the weighted perimeter portion 42. Preferably, as shown in FIGS. 1 and 2, these reinforcing members are disposed radially around the hitting surface 38.

Fourth, in other embodiments, such as those shown in the following figures, the thinned portion may be offset backward from the hitting surface 38 and the weighted perimeter portion 40 so that the thinned portion 40 never comes in contact with the golf ball.

The thinned portion 40 allows the weighted perimeter portion 42 of the clubhead to be disposed further outward from the hitting surface 38 than in current cavity back clubs to increase the efficiency of the perimeter weighting. The efficiency of the perimeter weighting is increased because the moment arm between the weighted perimeter portion 42 and the hitting surface 38 is longer than in conventional cavity back clubs in which the weighted perimeter is immediately adjacent to the hitting surface or behind the hitting surface. In other words, the first embodiment of the present invention separates the weighted perimeter portion 42 from the hitting surface 38 and moves it outward where it can be more effective.

The aforementioned embodiment of the present invention also may be used to provide an "oversized" iron club head without substantially increasing the mass of the club head.

The embodiment of the invention shown in FIGS. 1–3 also has the advantage that it can be manufactured relatively easily and inexpensively by any suitable casting process well known to those of skill in the art of golf club making. Alternatively, the club head can be made by any other means for making golf clubs, such as by forging and the like. The club head can be made of any materials commonly used for golf clubs, including but not limited to iron, steel, graphite, and the like. It is also possible that portions of the club head can be made out of one material and other portions out of one or more other materials.

Figure 4:
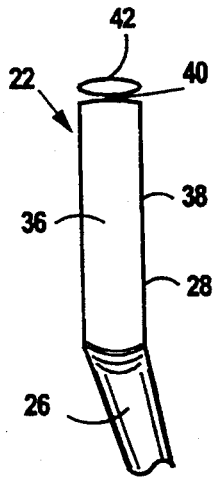
FIG. 4 is a cross-sectional view of an alternative embodiment taken along line 4—4 of FIG. 2 showing the sole of the club head and a section of the weighted perimeter portion of the club head.
Figure 5:
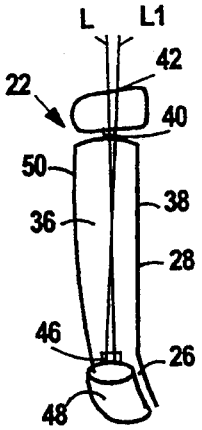
FIG. 5 is another alternative embodiment of the cross section having a weighted perimeter portion that is located at least partially forward of the hitting surface.

FIGS. 4 and 5 show several non-limiting alternative versions of the first basic embodiment of the present invention. FIG. 4, for instance, shows a version of the first embodiment in which thinned portion 40 is offset backward from the hitting surface 38. In other embodiments, the thinned portion 40 can be disposed forward of the hitting surface 38. However, such embodiments are generally not preferred.

FIG. 5 shows a highly preferred version of the first embodiment of the present invention in which at least a portion of the weighted perimeter portion 42 of the club head is disposed forward of the hitting surface of the club face. (It should be noted that more conventional club heads can be provided in such a configuration, and that such club heads are also within the scope of this aspect of the present invention, but that it works particularly well with the club head of the present invention.) This is a highly preferred feature of the present invention for a number of reasons.

Providing the club head with such a configuration provides a club head that appears to the golfer as though it fans forward toward the target rather than out from the rear of the toe of the club head as is the case in all current perimeter weighted golf clubs. This gives the club face the appearance of having a concave (or spoon-like) overall shape rather than a convex overall shape like current perimeter weighted clubs such as the PING ZING. Such a feature is believed to be highly useful in building confidence of the golfer that the club will not produce sliced shots.

The structure of the club head shown in FIG. 5 allows a portion of the weighted perimeter portion to be distributed in front of the hitting surface. This is believed to further increase the effectiveness of the club head in several ways. This weight distribution facilitates rotation of the toe of the club head relative to the heel through impact so as to square the club head and produce a straight shot or a shot with a slight draw.

Placement of the weight in such a manner is completely opposite of those methods currently used to attempt to achieve squaring of the club head at the ball. An example of one recent attempt to achieve squaring of the club head is the PEERLESS PHD golf club manufactured by ProGroup, Inc. shown in the September, 1993 issue of Golf Digest. The PEERLESS PHD golf club employs an extension of the hosel in a direction opposed to the toe of the club (i.e., toward the golfer when in his or her stance) to attempt to achieve "Maximum Perimeter Weighting" by positioning the weight a "full inch further from the center of gravity than traditional perimeter weighting will allow" to provide a greater moment of inertia (or resistance to twisting on off-center hits).

Without wishing to be bound by any particular theory, it is believed that providing weight in the toe of the club should be more effective in producing the desired rotation of the club head because the golf swing involves the application of centrifugal force and a larger mass in the toe will speed rotation of the toe of the club and increase the force applied by the toe.

The version of the club head shown in FIG. 5 is able to aid in achieving such rotation without interfering with the golfer's shot. This is due to the fact that the weighted perimeter portion 42 is not used in striking the ball. Ordinarily, providing a club head with a concave portion at the toe of its hitting surface would produce a shot that flies far left of target if this portion of the club head contacted the ball, but since it is spaced apart from the hitting surface, the weighted perimeter portion should not contact the ball. Thus, the ball will be contacted by the hitting surface 38 and will generally rotate or spin straight up the club face rather than laterally to the side of the hitting surface 38 toward the weighted perimeter portion 42.

Various other alternative embodiments of the first basic embodiment of the club head of the present invention or features thereof are possible.

For example, as shown in FIG. 5, the club head of the present invention can be provided with a weighted perimeter portion as described above, and a weighted hosel portion 48 extending in a direction opposed to the hose 26 in which an element like the so-called POWER WEDGE of the PEERLESS PHD clubs serves as a hosel spacer 46 for the weighted hosel portion 48. This can be used to create a club head with true maximum perimeter weighting. In a particularly preferred version of such an embodiment, the weighted perimeter portion 42 at the toe of the club head can be at least disposed at least partially forward of the hitting surface 38 as described above, and the weighted hosel portion 48 of the club head can be disposed rearward of the longitudinal centerline, L, of the club head so that the two weighted portions define an axis L1 that is rotated clockwise from the longitudinal centerline of the club head when the club head is viewed from the sole 36 to further aid in achieving maximum rotation through the ball. This can further be combined with a structure in which the back edge 50 of the sole of club head is convex outward to provide the golfer with additional confidence that the club will not produce sliced shots.

In other alternative embodiments, the thinned portion 40 of the club head can be extremely thin (e.g., thin as sheet metal), or even omitted in which case there will be a hole where the thinned portion ordinarily is, and the weighted perimeter portion will simply be connected to the hitting surface by the reinforcing members 44.

In still other alternative embodiments, the hitting surface 38 of the club head can be provided with a bulge similar to a wood for further compensating for misstruck shots.

The improved perimeter weighted golf clubs of the present invention comply with the Rules of the USGA because the thinned portion and the weighted perimeter portion are integral parts of the club head which are structural as well as functional.

II. Second Basic Embodiment

Figure 6:
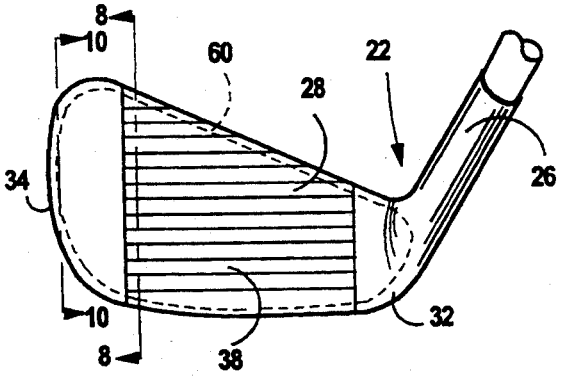
FIG. 6 is a front elevational view of the club head of the second basic embodiment of the present invention which is provided with a tubular frame.
Figure 7:
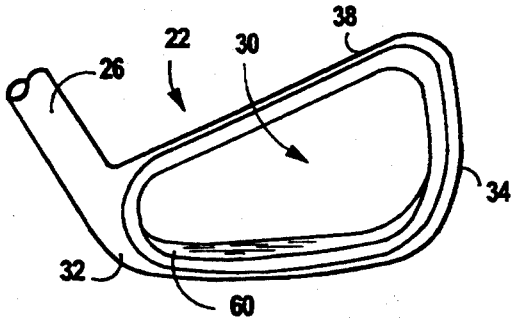
FIG. 7 is a perspective view of the rear of the club head shown in FIG. 6.

FIGS. 6–12 show that in another basic embodiment, the golf club comprises a club head with a main body (or frame) 60 which has at least a portion which is tubular. FIGS. 6 and 7 show the basic structure of such a club head 22.

Figure 10:
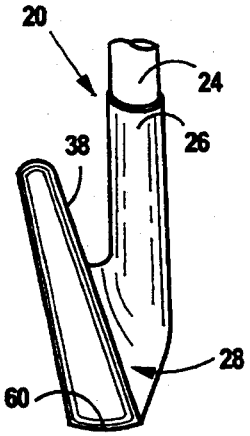
FIG. 10 is a cross sectional view of a club head like that shown in FIG. 6 only having a flattened tubular frame as it would appear from a section taken along line 10—10 of FIG. 6.

The tubular frame 60 may have any suitable cross-sectional shape. The cross-sectional shape of the tubular frame may be circular, oval, a flattened oval, square, or rectangular. In the particularly preferred versions of this embodiment shown in most of the drawing figures, the tubular portion of the frame is a flattened tubular structure. FIG. 10 shows an embodiment in which the tubular structure has a rectangular cross-sectional shape.

The tubular structure provides a strong frame that is much lighter in weight than perimeter weighted golf clubs of the type described in the aforementioned patents (which have a solid metal frame). This allows a much larger club head to be created without the mass of current perimeter weighted clubs.

Figure 8:
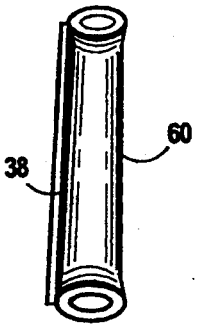
FIG. 8 is a cross sectional view of the club head shown in FIG. 6 taken along line 8—8 of FIG. 6.
Figure 9:
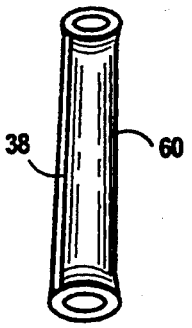
FIG. 9 is a cross sectional view of the club head shown in FIG. 6 having an alternative construction.

FIGS. 8 and 9 show two possible ways that the club face 28 may be affixed to the tubular frame 60. FIG. 8 shows an embodiment in which the entire back of club face 28 is attached to the front of the tubular frame (such as by welding, or the like). FIG. 9 shows an embodiment in which the club face is set into a portion of the tubular frame like an insert. U.S. Pat. No. 4,884,812 issued to Nagasaki, et al. and U.S. Pat. No. 5,282,625 issued to Schmidt, et al. show various ways that could be used for setting the club face as an insert into the tubular frame.

The tubular frame 60 can be made of any suitable material commonly used in the construction of golf clubs. The material used in the frame may, but need not be of a type of material or of a thickness that all portions of the frame are able to withstand a direct impact with a golf ball. For instance, the tubular frame 60 may be comprised of graphite similar to current oversize tennis racquets (in which the strings withstand the impact and the frame merely serves to support the strings). However, portions of the tubular frame, for instance, such as the leading edge of the club at the bottom of the sole, can be made thick enough as shown in FIG. 9, or reinforced to withstand impact with a golf ball.

Figure 11:
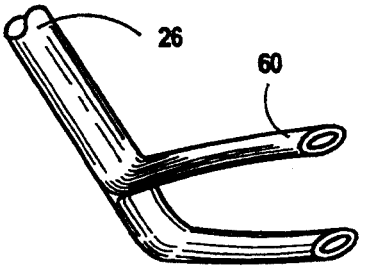
FIG. 11 is a fragmentary perspective view showing how the tubular frame of the club head might be fashioned from an extension of the hosel.

The tubular frame 60 can be made by any suitable method. For instance, the tubular frame can be extruded or made by any of the technologies commonly used in making pipes. Alternatively, the tubular frame 60 can be made by any methods known for use in making golf club shafts. In addition, FIG. 11 shows that in one embodiment, the frame 60 can comprise an extension of the shaft or hosel of the club. In such a case, the hollow hosel 26 can be formed into a loop-like structure and secured to itself to form the frame 60. In still other embodiments, the frame 60 can be made by any of the technologies described in the patent literature for making "wide body" tennis racquets out of graphite and the like.

Figure 12:
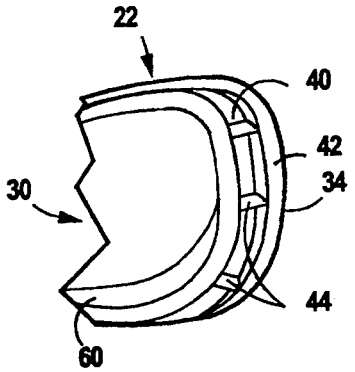
FIG. 12 is a fragmentary perspective view of rear of an embodiment in which the club head is provided with a weighted perimeter portion outboard of the tubular frame.

Various alternative versions of the second embodiment are also possible. The second embodiment of the improved perimeter weighted golf club head of the present invention can, for example, be provided with any of the features described in this specification as being suitable for use on the first basic embodiment. FIG. 12 shows an example of such an embodiment where the tubular club head is provided with a weighted perimeter portion 42 that is spaced away from the frame by a thinned portion 40.

The disclosures of all patents and publications mentioned throughout this patent application are hereby incorporated by reference herein. It is expressly not admitted, however, that any of the documents incorporated by reference herein teach or disclose the present invention. It is also expressly not admitted that any of the commercially available materials or products described herein teach or disclose the present invention.

While particular embodiments of the present invention have been illustrated and described, it would be obvious to those skilled in the art that various other changes and modifications can be made without departing from the spirit and scope of the invention. (For example, most of the discussion herein was directed to weighting a club head so that a counter clockwise rotation through the ball could be achieved for a right handed golfer. It is also within the scope of the present invention to arrange the weighting in a directly opposite manner to achieve the opposite type of rotation if a golfer desires.)

What is claimed is:

1. A perimeter weighted golf club comprising a club head having a club face which includes a hitting surface, a toe portion, a heel portion, and a sole portion extending generally between said heel portion and said toe portion, a weighted perimeter portion which forms at least a portion of the perimeter of said club head, and a spacer which connects at least a portion of said weighted perimeter portion to said hitting surface, wherein said hitting surface has a thickness and said spacer has a thickness which is less than that of said hitting surface so that there is a thinned section of said club head between said hitting surface and said weighted perimeter portion.

2. The golf club of claim 1 wherein said thinned section is positioned between said hitting surface and said toe portion.

3. The golf club of claim 1 wherein at least a portion of said thinned section is reinforced.

4. The golf club of claim 1 wherein said hitting surface defines a plane and at least a portion of said weighted perimeter portion is positioned forward of the plane of said hitting surface.

5. A golf club head having a club face which includes a hitting surface, a heel portion, a toe portion, and a sole portion extending generally between said heel portion and said toe portion, a frame that supports said hitting surface and that is located outboard of at least a portion of said hitting surface, wherein at least a portion of said frame is tubular.

6. The golf club head of claim 5 wherein said tubular portion of said frame is flattened.

7. The golf club head of claim 5 wherein said tubular portion of said frame also forms at least part of a hosel for said golf club head.

8. The golf club head of claim 5 wherein at least part of said tubular portion of said frame is reinforced.

9. The golf club head of claim 8 wherein said reinforced part of said tubular frame is thickened.

10. The golf club head of claim 5 wherein at least part of the tubular portion of said frame is hollow.

11. The golf club head of claim 5 wherein said hitting surface comprises a top portion, a bottom or sole portion, a heel portion, and a toe portion, and said tubular portion of said frame is disposed adjacent at least said top portion of said hitting surface.

12. The golf club head of claim 5 wherein said hitting surface comprises a top portion, a bottom or sole portion, a heel portion, and a toe portion, and said tubular portion of said frame is disposed adjacent at least said bottom portion of said hitting surface.

13. The golf club head of claim 5 wherein said hitting surface comprises a top portion, a bottom or sole portion, a heel portion, and a toe portion, and said tubular portion of said frame is disposed adjacent at least said toe portion of said hitting surface.

14. The golf club head of claim 5 wherein said hitting surface comprises a top portion, a bottom or sole portion, a heel portion, and a toe portion, and said tubular portion of said frame is disposed adjacent at least said heel portion of said hitting surface.

15. The golf club head of claim 5 wherein said tubular frame surrounds at least a portion of said hitting surface.

16. The golf club head of claim 15 wherein said tubular frame surrounds said entire hitting surface.

17. An iron-type golf club head comprising a club face having a loft of greater than or equal to about 17 degrees which includes a hitting surface, a heel portion, a toe portion, a sole portion extending generally between said heel portion and said toe portion, and an extension beyond said hitting surface along at least part of said toe portion that is positioned forward of said hitting surface.

18. The golf club head of claim 17 wherein said extension comprises a weighted portion of said club head.

19. The golf club head of claim 17 further comprising a spacer which connects said extension beyond said hitting surface to at least a portion of said hitting surface wherein said hitting surface and said spacer each have a thickness, and said spacer has a thickness which is less than that of at least a portion of said hitting surface so that there is a thinned section of said club head between said hitting surface and said extension beyond said hitting surface.

20. The golf club of claim 17 wherein said sole portion comprises a leading edge, said leading edge being comprised of a portion of said hitting surface and a portion of said extension beyond said hitting surface, and said leading edge forms a continuous concave curve from said heel portion to said toe portion.

21. A perimeter weighted golf club head having a club face which includes a hitting surface, a heel portion, a toe portion, and a sole portion extending generally between said heel portion and said toe portion, a weighted perimeter portion which forms at least a portion of the perimeter of said club head, and a spacer which connects at least a portion of said weighted perimeter portion to said hitting surface, wherein said hitting surface has a thickness and said spacer has a thickness which is less than that of at least a portion of said hitting surface so that there is a thinned section of said club head between at least a part of said hitting surface and said weighted perimeter portion.

22. The golf club head of claim 21 wherein at least a portion of said spacer is flush with said hitting surface.

23. The golf club head of claim 21 wherein said spacer is offset rearwardly from said hitting surface.

24. The golf club head of claim 21 wherein said spacer has a width and the width of said spacer varies at locations disposed around different portions of said hitting surface.

25. The golf club head of claim 21 wherein at least a portion of said thinned section is reinforced with reinforcing members that are radially disposed with respect to said hitting surface.

26. A perimeter weighted golf club head having a club face which includes a hitting surface, a heel portion, a toe portion, and a sole portion extending generally between said heel portion and said toe portion, a weighted perimeter portion which forms at least a portion of the perimeter of said club head, and a spacer which connects at least a portion of said weighted perimeter portion to said hitting surface, said hitting surface having a thickness, and said spacer having a width and a thickness, wherein the width of at least a portion of said spacer is greater than or equal to about $\frac{1}{8}$ inch and the thickness of said spacer is less than that of at least a portion of said hitting surface so that there is a thinned section of said club head between at least a part of said hitting surface and said weighted perimeter portion.

27. A perimeter weighted golf club head having a club face which includes a hitting surface, a heel portion, a toe portion, and a sole portion extending generally between said heel portion and said toe portion, a weighted perimeter portion which forms at least a portion of the perimeter of said club head, and a spacer which connects at least a portion of said weighted perimeter portion to said hitting surface, said hitting surface having a thickness, and said spacer having a width and a thickness, wherein the width of at least a portion of said spacer is greater than or equal to about $\frac{1}{4}$ inch and the thickness of said spacer is less than that of at least a portion of said hitting surface so that there is a thinned section of said club head between at least part of said hitting surface and said weighted perimeter portion.

28. The golf club head of claim 27 wherein at least a portion of said spacer has a width of greater than or equal to about $\frac{1}{2}$ inch.

29. The golf club head of claim 27 wherein at least a portion of said spacer has a width of greater than or equal to about $\frac{3}{4}$ inch.

30. The golf club head of claim 27 wherein at least a portion of said spacer has a width of greater than or equal to about 1 inch.

31. A golf club head having a club face which includes a hitting surface, a heel portion, a toe portion, and a sole portion extending generally between said heel portion and said toe portion, a frame that supports said hitting surface and that is located outboard of at least a portion of said hitting surface, wherein at least a portion of said frame defines at least a part of a tubular structure.

32. A golf club head according to claim 31 which is an iron wherein said portion of said frame has a cross section that defines an arc comprised of straight segments, curvilinear segments, or both, and said arc subtends an angle of greater than about 270 degrees.

33. A golf club head according to claim 31 which is a "metal" wood.

* * * * *